US007913942B2

(12) United States Patent
Vuorio

(10) Patent No.: US 7,913,942 B2
(45) Date of Patent: Mar. 29, 2011

(54) REFINER

(75) Inventor: Petteri Vuorio, Valkeakoski (FI)

(73) Assignee: Metso Paper, Inc., Helsinki (FI)

( * ) Notice: Subject to any disclaimer, the term of this patent is extended or adjusted under 35 U.S.C. 154(b) by 318 days.

(21) Appl. No.: 12/162,419

(22) PCT Filed: Jan. 29, 2007

(86) PCT No.: PCT/FI2007/050047

§ 371 (c)(1),
(2), (4) Date: Nov. 26, 2008

(87) PCT Pub. No.: WO2007/085703

PCT Pub. Date: Aug. 2, 2007

(65) Prior Publication Data

US 2009/0145990 A1 Jun. 11, 2009

(30) Foreign Application Priority Data

Jan. 30, 2006 (FI) ..... 20065065

(51) Int. Cl.
*B02C 7/06* (2006.01)
*B02C 13/20* (2006.01)

(52) U.S. Cl. ..... 241/261.2; 241/261.3; 241/296; 241/298

(58) Field of Classification Search ..... 241/261.2, 241/262.3, 296, 298
See application file for complete search history.

(56) References Cited

U.S. PATENT DOCUMENTS

| | | | | |
|---|---|---|---|---|
| 3,149,792 | A | 9/1964 | Textor | |
| 4,023,737 | A * | 5/1977 | Leider et al. | 241/261.3 |
| 5,354,005 | A | 10/1994 | Mladota | |
| 5,362,003 | A * | 11/1994 | Virving | 241/261.3 |
| 5,425,508 | A | 6/1995 | Chaney | |
| 5,683,048 | A * | 11/1997 | Virving | 241/261.2 |
| 6,042,036 | A * | 3/2000 | Virving et al. | 241/261.3 |
| 6,276,622 | B1 * | 8/2001 | Obitz | 241/261.3 |
| 7,191,967 | B2 * | 3/2007 | Vuorio et al. | 241/261.3 |
| 2003/0071155 | A1 | 4/2003 | Healey | |
| 2004/0118959 | A1 * | 6/2004 | Virving | 241/261.3 |
| 2004/0149844 | A1 | 8/2004 | Antensteiner | |

FOREIGN PATENT DOCUMENTS

| | | | |
|---|---|---|---|
| EP | 1 088 932 | A2 | 4/2001 |
| WO | WO 97/18037 | A1 | 5/1997 |
| WO | WO 99/13989 | A1 | 3/1999 |
| WO | WO 99/54046 | A1 | 10/1999 |

* cited by examiner

*Primary Examiner* — Bena Miller
(74) *Attorney, Agent, or Firm* — Alston & Bird LLP

(57) ABSTRACT

A refiner (1) comprising a stator (2) and a rotor (6) that comprise a planar portion and a conical portion after the planar portion, which in turn comprise refining surfaces (4, 8) provided with blade bars (15, 18, 24) and blade grooves (16, 19, 25) therebetween, and the planar portions (4', 81) of the refining surfaces (4, 8) of the stator (2) and the rotor (6) comprising at least two refining zones (14, 17, 23) in the direction of the radius (R) of the planar portion. At least the planar portion (8') of the refining surface (8) of the rotor (6) is provided with blade bars (18) in its outermost refining zone (17) in the direction of the radius (R), the blade bar angle (α) of the blade bars being arranged so as to provide pumping blade bars, and their blade bar angle (α) being greater than the blade bar angle (α) of the blade bars (15, 24) in the previous refining zone (14, 24) in the direction of the radius (R) of the planar portion (8') and that the blade bar angle (α) is 5-50 degrees so that the blade bars (18) in the outermost refining zone (17) have an overall pumping effect on the material to be refined.

18 Claims, 3 Drawing Sheets

REFINER

BACKGROUND OF THE INVENTION

The invention relates to a refiner comprising a stator and a rotor, the stator and the rotor comprising a planar portion and a conical portion after the planar portion, the planar portion and the conical portion comprising refining surfaces provided with blade bars and blade grooves therebetween, and the planar portions of the refining surfaces of the stator and the rotor comprising at least two refining zones in the direction of the radius (R) of the planar portion.

The invention further relates to a blade segment of a refining surface of a refiner, which blade segment is configurable to form at least part of the refining surface of the stator or the rotor of the refiner and which comprises blade bars and blade grooves therebetween, which together form the refining surface of the blade segment, and which blade segment is provided with at least two refining zones in the direction of the radius of the refining surface.

Refiners for processing fibrous material typically comprise two, but possibly also more, oppositely situated refining surfaces, at least one of which is arranged to rotate about a shaft such that the refining surfaces turn with respect to one another. The refining surfaces of the refiner, i.e. its blade surfaces or the blade set, typically consist of protrusions, i.e. blade bars, provided in the refining surface and blade grooves between the blade bars. Hereinafter, blade bars may also be referred to as bars and blade grooves as grooves. The refining surface consists of a plural number of juxtaposed blade segments, in which case the refining surfaces of individual blade segments together form an integral, uniform refining surface.

WO 97/18307 discloses a refiner provided with a stator, i.e. a fixed, immobile refiner element, and a refiner element to be rotated by means of a shaft, i.e. a rotor. Both the stator with its refining surface and the rotor with its refining surface are formed of a planar portion substantially perpendicular to the rotor shaft and a conical portion provided after this planar portion and arranged at an angle to the planar portion. The planar and conical portions of the stator and the rotor are spaced apart such that a blade gap is formed between the refining surface of the stator and the refining surface of the rotor. The fibrous material to be refined is fed into the blade gap between the planar portions of the stator and the rotor. As the material to be refined is being processed, it moves forward in the blade gap into the blade gap between the conical portions of the stator and the rotor and finally away from the blade gap.

A problem with the refiner type disclosed in WO 97/18307 is the turning point formed by the planar portion and the conical portion, because already the change it causes in the direction of travel of the material to be refined complicates the feeding of the material to be refined from the planar portion to the conical portion. This harmful effect is further aggravated by the fact that also the point of inversion and the high pressure of steam created in the refining process set in this same area. The fibres therefore remain long at this location and get accumulated there, which in turn leads to high energy consumption and high pressure, which tends to open the refiner blades and thereby cause additional stress on the refiner structure.

SUMMARY OF THE INVENTION

An object of the invention is a novel refiner providing enhanced feed of fibrous material from the planar portion to the conical portion.

The refiner of the invention is characterized in that at least the planar portion of the refining surface of the rotor is provided with blade bars in its outermost refining zone in the direction of the radius, the blade bar angle of the blade bars being arranged so as to provide pumping blade bars, and their blade bar angle being greater at least on the outermost portion of the outermost refining zone of the planar portion than the blade bar angle of the blade bars in the previous refining zone in the direction of the radius of the planar portion and that the blade bar angle of the pumping blade bars of said outermost refining zone is 5-50 degrees so that the blade bars in the outermost refining zone have an overall pumping effect on the material to be refined.

A blade segment of the invention is characterized in that in its outermost refining zone in the direction of the radius, the refining surface is provided with blade bars, the blade bar angle of the blade bars being arranged so as to provide pumping blade bars when the refiner is in use, and their blade bar angle being greater at least on the outermost portion of the outermost refining zone of the refining surface than the blade bar angle of the blade bars in the previous refining zone in the direction of the radius of the refining surface and that the blade bar angle of the pumping blade bars of the outermost refining zone is 5-50 degrees so that the blade bars in the outermost refining zone have an overall pumping effect on the material to be refined.

The refiner comprises a stator and a rotor, the stator and the rotor comprising a planar portion and a conical portion after the planar portion. The planar portion and the conical portion further comprise refining surfaces provided with blade bars and blade grooves between the blade bars, the planar portions of the refining surfaces of the stator and the rotor comprising at least two refining zones in the radial direction of the planar portions. Further, at least in the radially outermost refining zone of the planar portion of the refining surface of the rotor, there are provided blade bars configured to form blade bars having a pumping blade bar angle, their blade bar angle being greater at least on the outermost portion of the outermost refining zone of the refining surface than the blade bar angle of the blade bars in the previous refining zone in the radial direction of the planar portion, and that the blade bar angle of the pumping blade bars in the outermost refining zone is 5-50 degrees so that the blade bars in the outermost refining zone have an overall pumping effect on the material to be refined.

A pumping blade bar is a blade bar that produces in the mass particle to be refined both a circular velocity component and a radial velocity component directed away from the centre of the refining surface. The direction of the blade bar angle between the pumping blade bar and the refining surface radius is opposite to the direction of rotation of the refiner blade, this direction of the blade bar angle being referred to the positive direction of the blade bar angle.

This allows an improved material feed from the planar portion of the refiner to its conical portion to be obtained. Compared with prior art solutions, the residence time of the fibres to be refined is shortened and their accumulation is reduced at the transition point between the planar portion and the conical portion. When mass feed from the refiner's planar portion to its conical portion is to be enhanced without substantially affecting the quality of the mass or the specific energy consumption of the refiner, a small blade bar angle that nevertheless enhances flow from the planar portion to the conical portion is selected. Although a small blade bar angle does not significantly change energy consumption, feed from the planar portion to the conical portion is enhanced such that the production capacity of the refiner can be increased. At the same time, the axial forces of the refiner are reduced. When the energy consumption of the refiner is to be decreased, a greater blade bar angle is selected. Compared with prior art solutions, a blade bar angle of 10-40 degrees or 20 to 35 degrees, for example, provide not only enhanced feed but also significant energy savings in refining.

BRIEF DESCRIPTION OF THE FIGURES

Some embodiments of the invention will be discussed in greater detail with reference to the accompanying figures, in which.

For the sake of clarity, some embodiments of the invention are simplified in the Figures. Like parts are indicated with like reference numerals.

A DETAILED DISCLOSURE OF SOME EMBODIMENTS OF THE INVENTION

Figure 1:
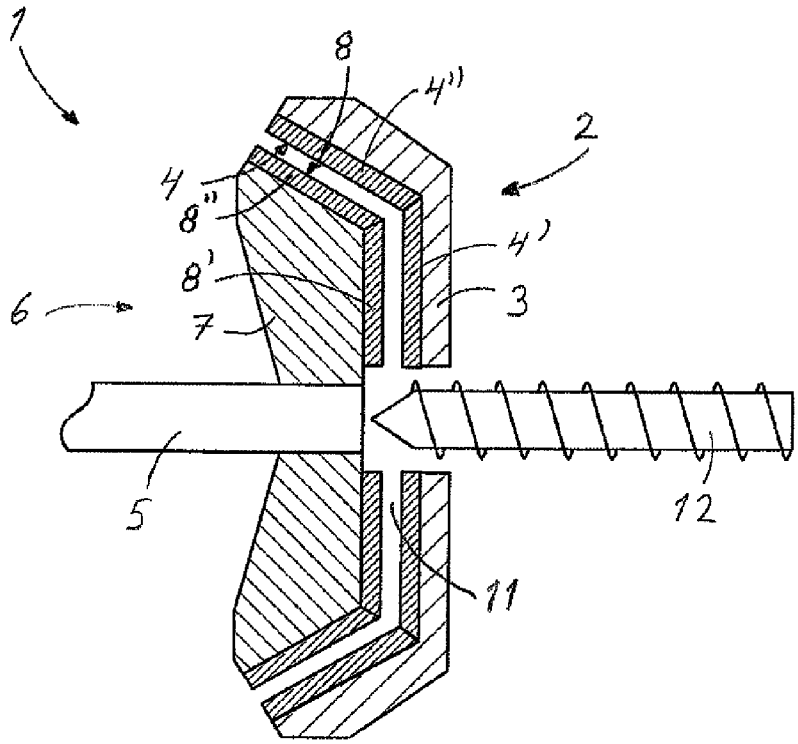
FIG. 1 is a schematic view of a refiner in which the disclosed refining surface solution can be applied.

FIG. 1 is a schematic view of a refiner 1 for refining fibrous material. The refiner 1 is provided with a fixed stator 2, supported to a frame 1 not shown in FIG. 1, the stator 2 comprising a frame part 3 of the stator 2 and a refining surface 4 consisting of blade bars and blade grooves, i.e. a refiner blade or blade set. Further, the refiner 1 is provided with a rotor 6, arranged to be rotated by a shaft 5 and motor, not shown, the rotor 6 comprising a frame part 7 of the rotor 6 and a refining surface 8 consisting of blade bars and blade grooves, i.e. a refiner blade or blade set. The refining surface 4 of the stator 2 consists of a planar portion 4', which is arranged substantially perpendicularly to the shaft 5, and a conical portion 4", which is arranged at a predetermined angle to the planar portion 4'. Correspondingly, the refining surface 8 of the rotor 6 consists of a planar portion 8', which is arranged substantially perpendicularly to the shaft 5, and a conical portion 8", which is arranged at an angle to the planar portion 8' corresponding to the angle between the planar portion 4' and the conical portion 4" of the stator refining surface 4. The rotor 6 is arranged at a distance from the stator 2 in such a way that a blade gap 11 is left between the refining surface 8 of the rotor 6 and the refining surface 4 of the stator 2. The size of the blade gap of the conical portion and the planar portion may be preferably adjusted by moving the rotor 6 closer to or further away from the stator 2 by means of the shaft 5. The blade gap of the planar portion may be adjusted separately by moving the stator 2 of the planar portion closer to or further away from the rotor 6. The fibrous material to be refined is fed by means of a feed screw 12, for example, through the centre of the planar portions 4', 8' of the refining surfaces 4 and 8 to the blade gap 11, where the fibrous material is refined and, at the same time, it moves between the planar portion 4' of the refining surface 4 of the stator 2 and the planar portion 8' of the refining surface 8 of the rotor 6 towards a portion between the conical portions 4', 8' in the blade gap 11 and finally away from the blade gap 11. A person skilled in the art is familiar with the general structure and operating principle of refiners and therefore they shall not be discussed further in this context.

Figure 2:
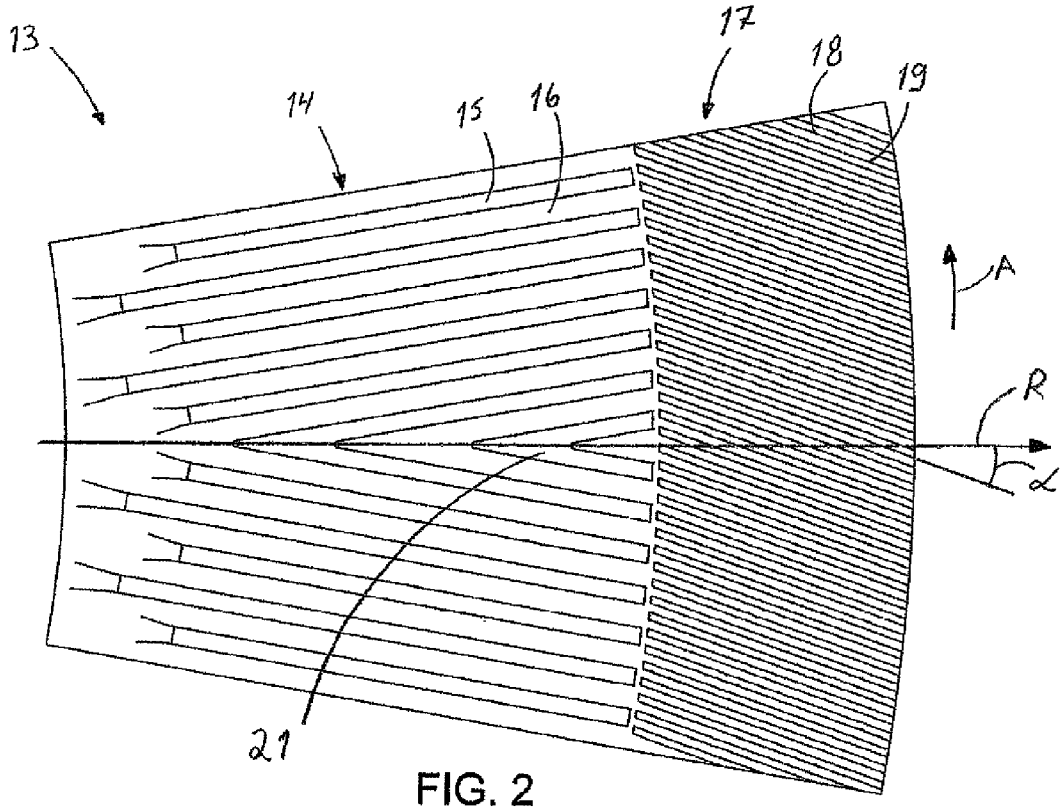
FIG. 2 is a schematic view of a blade segment of a planar portion of a refiner.

FIG. 2 is a schematic view of a blade segment 13 in the planar portion 8' of the refining surface 8 of a rotor 6, the segment being meant to form part of the integral refining surface of the planar portion 8' of the rotor 6. A similar blade segment may naturally be used also in the planar portion 4' of the refining surface 4 of the stator 2. The blade segment 13 of FIG. 2 is provided with two refining zones, a first or inner refining zone 14 in the direction of the refining surface radius R and a second or outer refining zone 17 in the direction of the refining surface radius R. The refining zone 14 comprises blade bars 15 and blade grooves 16 between the blade bars. The blade bars 15 take care of refining the fibrous material to be refined and the blade grooves 16 carry forward the fibrous material to be refined as well as the refined material and also take care of conveying the steam created during the refining away from the blade gap 11. As the refining of the fibrous material proceeds, the material to be refined moves forward from the inner refining zone 14 to the outer refining zone 17, i.e. to the outermost refining zone 17, when seen in the direction of the radius R of the blade segment 13. The refining zone 17 further comprises blade bars 18 and blade grooves 19 which in FIG. 2 are narrower than the blade bars and the blade grooves of the inner refining zone 14 in order for a greater refining efficiency. The blade bars 18 of the outer refining zone 17 are configured so as to provide pumping blade bars by adjusting the blade bar angle $\alpha$ between the blade bars 18 and the radius R of the refining surface of the planar portion at a specific angle in relation to the radius R, the blade bar angle $\alpha$ being greater than the angle between the blade bars 14 in the inner refining zone 14 and the radius R of the refining surface in the planar portion. The blade bar angle $\alpha$ between the radius R and the blade bars 17 of the outer refining zone may be 5-50 degrees, for example.

A pumping blade bar is a blade bar that produces for a mass particle to be refined both a circular velocity component and a velocity component directed away from the centre of the refining surface in the direction of the radius R of the refining surface. The blade bar angle $\alpha$ between a pumping blade bar and the radius R of the refining surface is thus directed opposite to the direction of rotation of the refining surface as shown in FIG. 2, where arrow A indicates the direction of rotation of the rotor 6. This blade bar direction is typically referred to as the positive direction of the blade bar angle. The direction of the blade bars 18 naturally also determines the direction of the blade grooves 19.

FIG. 2 shows an arrangement of the blade bars of the outer refining zone 17, or the outermost refining zone of three or more refining zones, on the outer periphery of the refining surface, which enables to improve the feed of the material to be refined from the planar portion of the refiner 1 to its conical portion. Compared with prior art solutions, the residence time of the fibres to be refined in the transition point between the planar portion and the conical portion is decreased and their accumulation is reduced. A small blade bar angle, which nevertheless enhances flow from the planar portion to the conical portion, enables a sufficient improvement of feed from the planar portion to the conical portion to be obtained without substantially affecting the quality of the mass. Compared with the small angle, a large blade bar angle enhances the feed from the planar portion to the conical portion more, thus allowing the energy consumption of the refiner to be reduced. Consequently, the selected blade bar angle $\alpha$ is preferably 10-40 degrees, more preferably 20-35 degrees, which enable not only more efficient feed but also considerable energy savings in the refining to be obtained in comparison with prior art solutions. The blade bar angle of the refining zone before the outermost refining zone being smaller than the blade bar angle of the pumping blade bars in the outermost refining zone prevents the material to be refined from moving too quickly away from the blade gap in the planar portion of the refiner, and therefore the quality of the refined material is not impaired.

Figure 3:
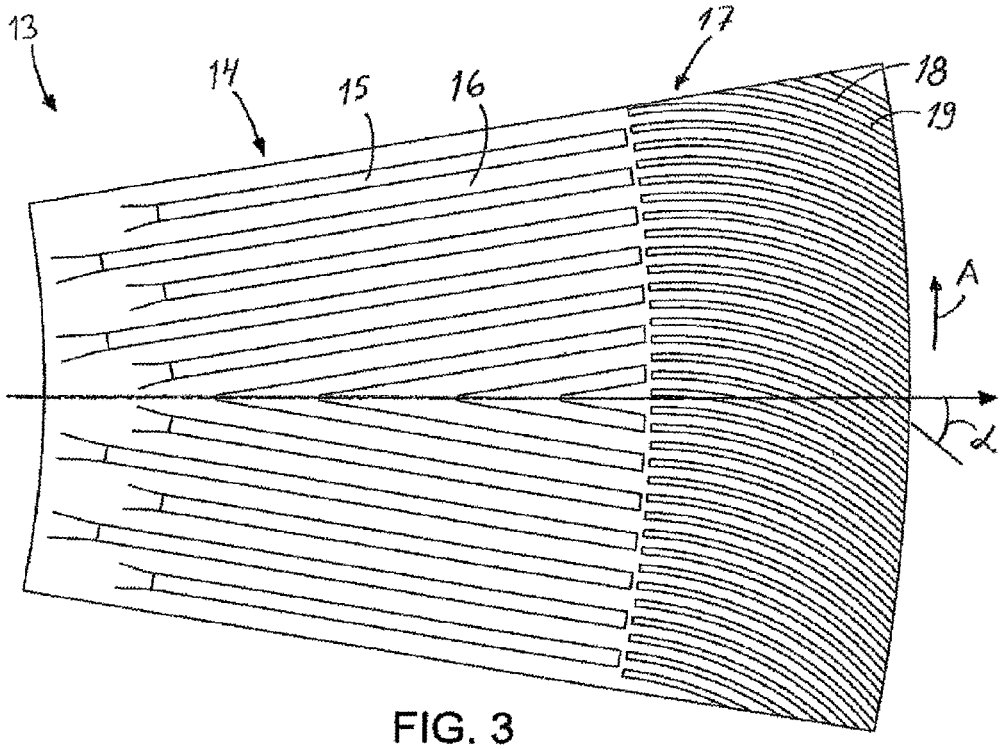
FIG. 3 is a schematic view of a second blade segment of a planar portion of a refiner.

In the blade segment of FIG. 2 the blade bars 18 of the outermost refining zone 17 are all pumping blade bars, and their blade bar angle α remains constant in the direction of the refining surface radius R from the centre of the refining surface towards the periphery of the refining surface. FIG. 3 shows a blade segment 13, in which the blade bar angle α of the blade bars 18 in the outermost refining zone 17 increases in the direction of the refining surface radius R from the centre of the refining surface towards the periphery of the refining surface. In the blade segment of FIG. 3, the blade bars are curved in such a way that the blade bars at the beginning of the outermost refining zone, i.e. on the side of the inner refining zone, are substantially parallel to the radius R, but the blade bar angle α increases relatively quickly towards the periphery of the blade segment, whereby the blade bars 18 at least on the outermost portion of the outermost refining zone 17 of the refining surface are pumping blade bars.

Figure 4:
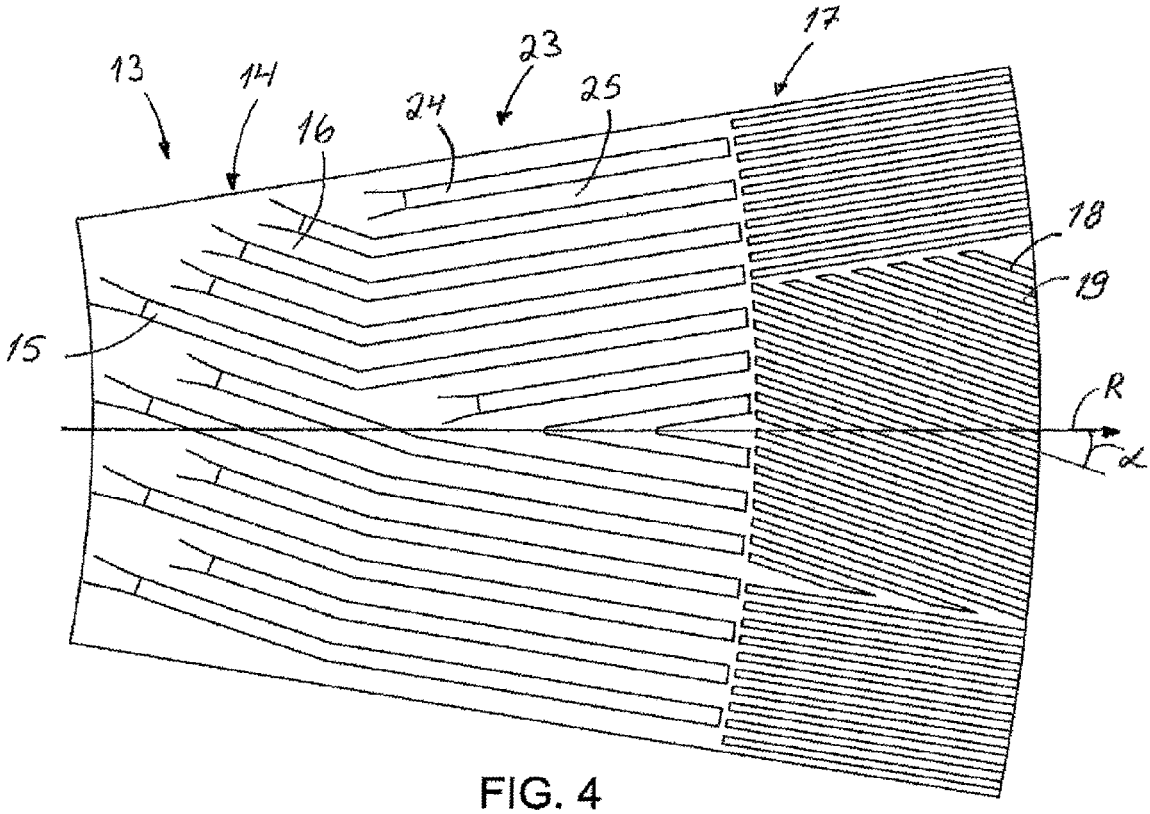
FIG. 4 is a schematic view of a third blade segment of a planar portion of a refiner.

FIG. 4 in turn shows a blade segment 13 which has three refining zones, an innermost refining zone 14 provided with blade bars 15 and blade grooves 16, an outermost refining zone 17 provided with blade bars 18 and blade grooves 19, and, between the innermost refining zone 14 and the outermost refining zone 17, a middle refining zone 23 provided with blade bars 24 and blade grooves 25. In the blade segment 13 of FIG. 4 only part of the blade bars 18 in the outermost refining zone 17 in the direction of the refining surface radius R are arranged to be pumping, as described above, and to thereby enhance the feed of the fibrous material to be refined from the planar portion of the refiner 1 to its conical portion. The blade bar angle α of the pumping blade bars 18 of the blade segment 13 of FIG. 4 is selected such that the blade bars of the outermost refining zone 17 of the blade bars of the outermost refining zone produce an overall pumping effect on the material to be refined, i.e. the outermost refining zone provides a resultant pumping effect that enhances the flow from the planar portion to the conical portion, irrespective of whether there are also retentive blade bars in the outermost refining zone or blade bars that have no effect on the travel of the mass in the blade gap.

A retentive blade bar is a blade bar that produces in the mass particle to be refined both a circular velocity component and a velocity component in the direction of the radius R towards the centre of the refining surface. In other words, a retentive blade set tends to prevent the fibrous material to be refined from moving away from the blade gap.

Figure 5:
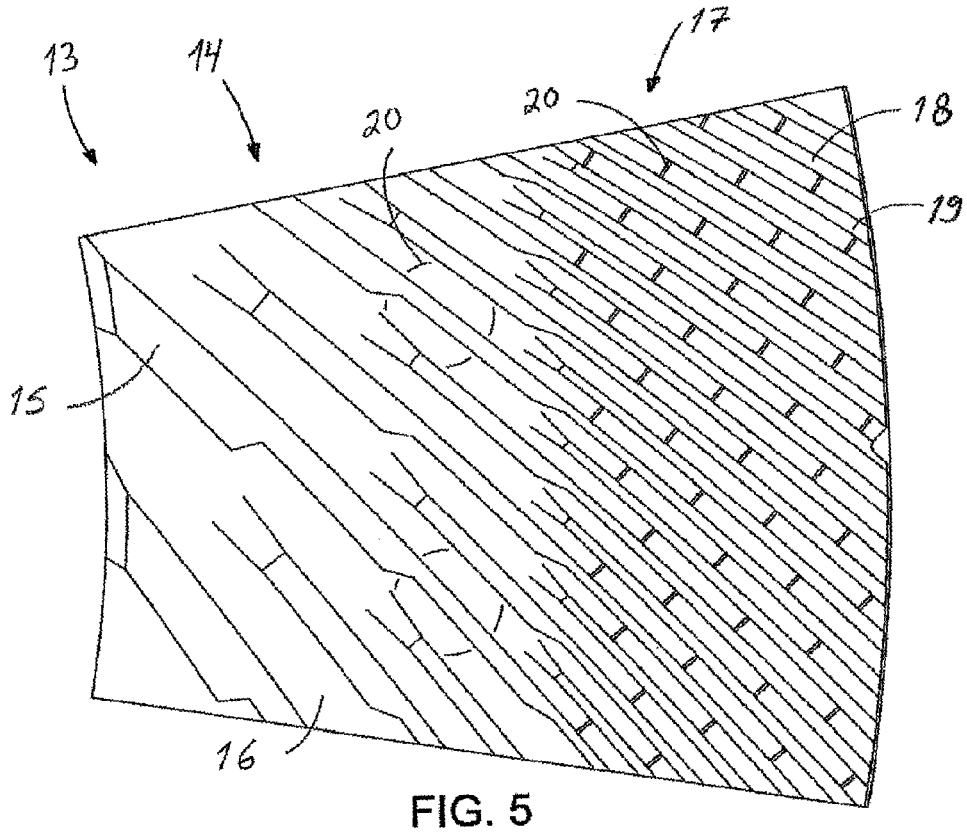
FIG. 5 is a schematic view of a fourth blade segment of a planar portion of a refiner.

FIG. 5 shows a blade segment 13, where the blade bars 15, 18 of both the inner refining zone 14 and the outer refining zone 17 are curved, although such that the blade bar angle α of the blade bars 18 in the outer refining zone 17 is greater in relation to the radius R of the refining surface than the blade bar angle of the blade bars 15 in the inner refining zone 14. FIG. 5 further shows schematically flow dams 20 arranged on the bottom of the blade grooves 16 and 19 and responsible for restricting and guiding the flow of the material to be refined.

The refining surface solutions of FIGS. 2-5 show two or three refining zones. However, four or more refining zones are also possible, in which case the refining zone that is outermost in the direction of the refining surface radius R is provided with blade bars arranged at least on a part of the length in the direction of the refining surface periphery, the blade bars being pumping and their blade bar angle in relation to the radius R is greater than that of the blade bars of the previous refining zone in the direction of the refining surface radius R, and the blade bar angle of the blade bars in the outermost refining zone being 5-50 degrees. The disclosed blade bar solution may be provided either solely on the refining surface of the rotor or on the refining surface of both the rotor and the stator. If the mass quality is to be left substantially unaffected, the outermost refining zone on the planar portion 4' of the refining surface 4 may be arranged retentive, whereby the angle of incidence between the blade bars of the outermost refining zones of the rotor refining surface and the stator refining surface remains small. The outermost refining zone on the planar portion 4' of the stator may be arranged retentive by ensuring that at least part of the blade bars in the outermost refining zone are retentive.

There are various ways for forming blade bars on the inner refining zones of the planar portion 4' of the refining surface 4, i.e. on other zones than the outermost refining zone 17. For example, the blade bars may be formed such that the blade bar angle between the radius R and the blade bar either increases, decreases or remains constant towards the periphery of the refining surface. It is also possible to have a conventional V-shaped blade bar, such as is schematically shown in FIG. 2 under reference numeral 21. In practice the blade bars in the inner refining zones may have any known shape. For example, if the refining surface is provided with three refining zones, the outermost of the zones being naturally as described above, the blade bar angle of the blade bars in the innermost refining zone may be 10-85 degrees, for example, and −20-+25 degrees, for example, in the middle zone. The innermost zone thus has a stimulating effect on the movement of the material to be refined, and that effect can then be slowed down in the middle zone in order to provide a better refining result, or further stimulated by selecting a positive refining angle, if lower energy consumption is to be aimed at. The blade bar angles provide means for controlling the residence time of the mass in the different refining zones of the refiner. This allows the refining result and energy consumption to be adjusted as desired. The greater the positive blade bar angle, the greater is the energy saving achieved, because residence time decreases, and thereby production capacity increases. A negative blade bar angle is used for increasing the residence time in the blade gap. The negative blade bar angle thus means a retentive blade bar angle. According to the disclosed solution, in that case the blade bar angle of the blade bars in the outermost refining zone is arranged greater than the blade bar angle in the previous zone such that the selected blade bar angle is 5 to 50 degrees at least at the end of the refining zone, exactly adjacent to the periphery of the refining surface.

Figure 6:
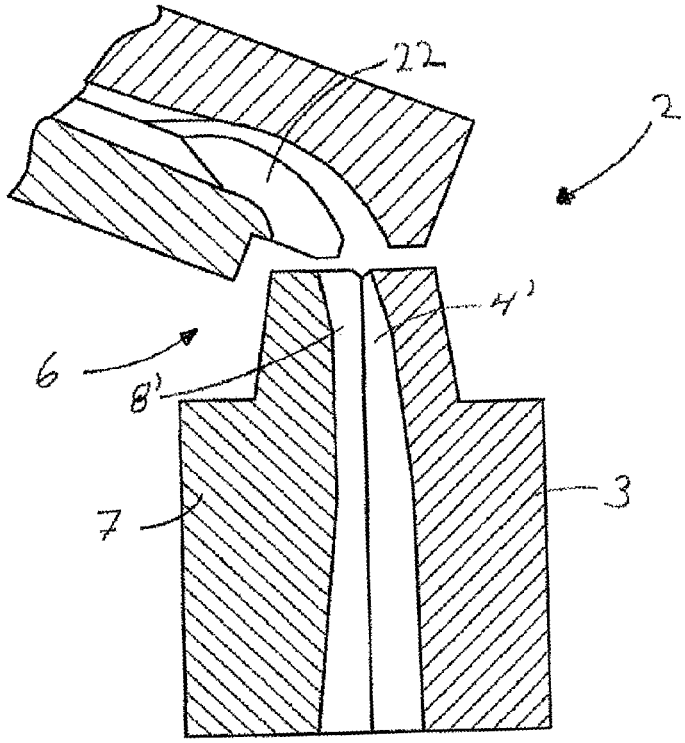
FIG. 6 is a schematic cross-sectional view of a detail in the refining surface of the planar portion of the refiner stator and in the refining surface of the planar portion of the refiner rotor.

The feed of the fibrous material from the planar portion of the refiner to its conical portion may be further enhanced by the solution shown in FIG. 6, in which the height of the stator blade bars decreases on the end part of the outermost refining zone of the planar portion and the height of the rotor blade bars increases towards the conical portion of the refiner. As the height of the stator blade bar decreases, the depth of the stator blade grooves naturally decreases as well and, correspondingly, as the height of the rotor blade bars increases, the depth of the rotor blade grooves increases.

This solution increases rotating movement in the fibrous material to be refined and makes it flow more powerfully towards the conical portion. The lower structure of the stator blade set in the immediate vicinity of the periphery of the planar portion of the refiner rotor prevents back flows of the material to be refined from the conical portion to the planar portion. FIG. 6 also includes a detail showing a guiding element 22 arranged on the conical portion for guiding the material to be refined that moves from the planar portion to the conical portion between the refining surfaces of the stator and the rotor on the conical portion of the refiner.

In some cases the features disclosed in the present application may be used as such, irrespective of the other features. On the other hand, the features disclosed in this application may be combined to produce different combinations, when necessary.

The drawings and the related specification are only intended to illustrate the inventive idea. The details of the invention may vary within the scope of the claims.

The invention claimed is:

1. A refiner comprising a stator and a rotor, the stator and the rotor each comprising a planar portion and a conical portion outward of the planar portion, the planar portion and the conical portion each comprising refining surfaces provided with blade bars defining blade grooves therebetween, and the planar portions of the refining surfaces of each of the stator and the rotor comprising at least two serially-disposed refining zones extending radially along the planar portion, wherein at least the planar portion of the refining surface of the rotor includes blade bars disposed in radially outermost refining zone, the blade bars having a blade bar angle configured so as to provide pumping blade bars, with the blade bar angle being greater, at least on a radially outermost portion of the radially outermost refining zone of the planar portion, than the blade bar angle of the blade bars in the previous refining zone disposed radially inward from and adjacent to the radially outermost refining zone of the planar portion, and wherein the blade bar angle of the pumping blade bars of the radially outermost refining zone is between about 5 degrees and about 50 degrees with respect to a radius of the planar portion so that the blade bars in the radially outermost refining zone have an overall pumping effect on material to be refined.

2. A refiner according to claim 1, wherein the blade bar angle of the pumping blade bars of the radially outermost refining zone is between about 10 degrees and about 40 degrees with respect to the radius of the planar portion, and preferably between about 20 degrees and about 35 degrees with respect to the radius of the planar portion.

3. A refiner according to claim 1, wherein all blade bars of the radially outermost refining zone of the planar portion of the refining surface of the rotor are pumping blade bars.

4. A refiner according to claim 1, wherein the blade bar angle of the pumping blade bars of the radially outermost refining zone of the refining surface is substantially constant for all pumping blade bars.

5. A refiner according to claim 1, wherein the blade bar angle of the pumping blade bars of the radially outermost refining zone increases toward a periphery of the planar portion of the refining surface.

6. A refiner according to claim 1, wherein the planar portion of the refining surface comprises three serially-disposed refining zones extending radially therealong.

7. A refiner according to claim 6, wherein, in the radial direction of the planar portion of the refining surface, the blade bar angle of the blade bars of the radially innermost refining zone is between about 10 degrees and about 85 degrees with respect to the radius of the planar portion, and the blade bar angle of the blade bars of the medial refining zone is between about −25 degrees and about +25 degrees with respect to the radius of the planar portion.

8. A refiner according to claim 1, wherein the blade bar angle of the blade bars of the radially outermost refining zone of the planar portion of the refining surface of the stator is configured to be retentive.

9. A refiner according to claim 1, wherein at least a portion of a length of each of the blade bars in the radially outermost refining zone of the planar portion of the refining surface of the stator has a height that decreases toward the periphery of the planar portion of the refining surface of the stator and wherein a corresponding at least a portion of a length of each of the opposing blade bars in the radially outermost refining zone of the planar portion of the refining surface of the rotor has a height that increases toward the periphery of the planar portion of the refining surface of the rotor.

10. A blade segment of a refining surface of a refiner comprising a stator and a rotor, the stator and the rotor each comprising a planar portion and a conical portion outward of the planar portion, the blade segment being adapted to form at least a radial segment of the refining surface of the stator or the rotor of the refiner and comprising blade bars defining blade grooves therebetween, the blade bars and blade grooves forming a refining surface of the blade segment, and each blade segment comprises a radially inward portion and a radially outward portion of the radial segment, and includes at least two serially-disposed refining zones extending along the refining surface from the radially inward portion toward the radially outward portion wherein the radially outermost refining zone of the refining surface includes blade bars having a blade bar angle configured so as to provide pumping blade bars when the refiner is in use, with the blade bar angle being greater, at least on a radially outermost portion of the radially outermost refining zone of the refining surface than the blade bar angle of the blade bars in the refining zone disposed radially inward from and adjacent to the radially outermost refining zone of the refining surface, and wherein the blade bar angle of the pumping blade bars of the radially outermost refining zone is between about 5 degrees and about 50 degrees with respect to a radius extending from radially inward portion through the radially outward portion of the radial segment so that the blade bars in the radially outermost refining zone have an overall pumping effect on material to be refined.

11. A blade segment according to claim 10, wherein the blade bar angle of the pumping blade bars of the radially outermost refining zone is between about 10 degrees and about 40 degrees with respect to the radius extending from radially inward portion through the radially outward portion of the radial segment, and preferably between about 20 degrees and about 35 degrees with respect to the radius extending from radially inward portion through the radially outward portion of the radial segment.

12. A blade segment according to claim 10, wherein all blade bars of the radially outermost refining zone of the refining surface are pumping blade bars.

13. A blade segment according to claim 10, wherein the blade bar angle of the pumping blade bars of the radially outermost refining zone of the refining surface is substantially constant for all pumping blade bars.

14. A blade segment according to claim 10, wherein the blade bar angle of the pumping blade bars of the radially outermost refining zone increases toward a periphery associated with the radially outward portion of the refining surface.

15. A blade segment according to claim 10, wherein the refining surface comprises three serially-disposed refining zones extending along the refining surface from the radially inward portion toward the radially outward portion.

16. A blade segment according to claim 15, wherein, in the radial direction of the refining surface, with respect to the radius extending from radially inward portion through the radially outward portion of the radial segment, the blade bar angle of the blade bars in the radially innermost refining zone is between about 10 degrees and about 85 degrees with respect to the radius extending from radially inward portion through the radially outward portion of the radial segment, and the blade bar angle of the blade bars in the medial refining zone is between about −25 degrees and about +25 degrees with respect to the radius extending from radially inward portion through the radially outward portion of the radial segment.

17. A blade segment according to claim 10, wherein the blade segment is adapted to form at least a radial segment of the refining surface of the stator, and wherein at least a portion of a length of each of the blade bars in the radially outermost refining zone of the refining surface of the blade segment has a height that decreases toward a periphery associated with the radially outward portion of the refining surface.

18. A blade segment according to claim 10, wherein the blade segment is adapted to form at least a radial segment of the refining surface of the rotor, and wherein at least a portion of a length of each of the blade bars in the radially outermost refining zone of the refining surface of the blade segment has a height that increases toward a periphery associated with the radially outward portion of the refining surface.

* * * * *